US005649358A

United States Patent [19]

Adachi et al.

[11] Patent Number: 5,649,358

[45] Date of Patent: Jul. 22, 1997

[54] METHOD OF MAKING A VALVE SEAT

[75] Inventors: Shuhei Adachi; Junichi Inami, both of Iwata, Japan

[73] Assignee: Yamaha Hatsudoki Kabushiki Kaisha, Japan

[21] Appl. No.: 278,026

[22] Filed: Jul. 20, 1994

[30] Foreign Application Priority Data

Jul. 20, 1993 [JP] Japan ..... 5-200325
Oct. 6, 1993 [JP] Japan ..... 5-250559

[51] Int. Cl.[6] ..... B23P 15/00

[52] U.S. Cl. ..... 29/888.4; 29/888.42; 29/890.124

[58] Field of Search ..... 29/888.4, 888.42, 29/888.06, 890.124, 890.122, 451, 453; 123/188.8

[56] References Cited

U.S. PATENT DOCUMENTS 1,397,167 11/1921 Hopper ..... 29/888.06
1,720,486 7/1929 Lupert ..... 29/888.06
1,795,433 3/1931 Lupert ..... 29/888.06
5,042,151 8/1991 Roush ..... 29/890.124
5,353,501 10/1994 Naugle ..... 29/890.124

*Primary Examiner*—Irene Cuda
*Attorney, Agent, or Firm*—Knobbe, Martens, Olson & Bear LLP

[57] ABSTRACT

A method for affixing a valve seat insert into a cylinder head recess using pressure or pressure in conjunction with resistance welding. The preferred method avoids the creation of tensile stresses within the valve seat insert during installation into the cylinder head. Further, the method reduces the size of an opening of the valve seat insert during installation. In addition, the application of pressure and the respective shapes of the recess and valve seat insert are such that a moment is not created in the insert which would result in the application of tensile forces on the insert. A lower surface opposite the combustion chamber of the valve seat insert is disposed at an angle to the opening within a range of ±15° to a plane which is perpendicular to the axis of the opening. Additionally, the valve seat insert may comprise multiple components which, when resistance welded to the cylinder head, form a plurality of intermetallic layers having gradually varying coefficients of thermal expansion.

34 Claims, 11 Drawing Sheets compression / power on welding / cooling milling completion

METHOD OF MAKING A VALVE SEAT

BACKGROUND OF THE INVENTION

This invention relates to a valve seat and more particularly to an improved method for forming the valve seat for an internal combustion engine and the resulting valve seat.

In conjunction with internal combustion engines, it is the practice to employ light alloy casting for the cylinder head. In order to permit more wear resistant, longer life operation, it has been the practice to provide an annular insert at the termination of the gas flow ports which serves as the seating surface for the poppet valve that controls the flow through the gas port. It is extremely important that the insert piece be well retained in the cylinder head for obvious reasons. It is generally the common practice to press fit the valve seat into the cylinder head. Although such press fitting operations normally provide good initial attachment, certain problems can occur during running of the engine, particularly as a result of the thermal stresses due to the differences in degrees in thermal expansion between the cylinder head and the valve seat insert and also as a result of the initial stresses in the cylinder head and insert caused during installation.

Where the engine is provided with multiple valves the amount of cylinder head material between adjacent valve seats may be extremely small and this gives rise to a problem of cracking. In addition, the bond between the cylinder head material and the valve seat can also become damaged either on installation or during running operation.

It has been discovered that one problem attendant to the previous valve inserts and methods of installation has been that the pressure applied to the insert when it is pressed into place can cause forces to be exerted on the insert which result in tensile stresses in the insert. Since the insert material is normally stronger in compression than in tension, these tensile stresses can cause failures either at installation or failures which do not manifest themselves until after the engine has run for some time period.

It is, therefore, a principle object of this invention to provide an improved valve seat and method of inserting the valve seat wherein tensile stresses on the insert during installation are substantially eliminated.

In the previous proposed methods for inserting valve seats it has been also noted that during the installation phase due to the way in which forces are applied and the shape of the insert and the receiving recess that the insert tends to have its diameter enlarged upon installation at least in localized areas. Again this also gives rise to the tensile stresses which, as has been noted, can result in cracking of the valve seat insert either on installation or after installation and during engine running.

It is, therefore, a still further object of this invention to provide an improved method for installing a valve seat insert in a corresponding cylinder head arrangement wherein the diameter of the insert opening is reduced rather than enlarged upon installation.

Attendant with the aforenoted problems, the method and structure of the valve seat and its method of insertion tends to cause a moment on the valve seat when it is installed that causes the valve seat diameter to enlarge as aforenoted.

It is, therefore, a still further object of this invention to provide an improved method and apparatus for forming a cylinder head having a valve seat wherein moments tending to cause tensile forces on the insert during installation are eliminated.

In order to further ensure good retention of the valve seat insert into the cylinder head, particularly where multiple valves are employed, it has been proposed to weld the insert to the cylinder head. This is done normally by a resistance welding technique wherein the insert is pressed into position while electrical current is applied to it so as to effect a weld between the insert and the cylinder head material. Resistance welding in this manner thus has many similarities to the use of pressed in inserts and can present the same potential damage for the reasons as aforenoted.

It is, therefore, a still further object of this invention to provide an improved method for resistance welding a valve seat insert into a cylinder head.

As has already been noted, the valve seat insert is formed from a different material from the main cylinder head material and the resistance welding of these dissimilar materials, particularly in the application for valve seats can give rise to additional problems. The different thermal expansions between the insert and the cylinder head can give rise to stresses between the insert and the cylinder head material even when welded in position.

It is, therefore, a still further object of this invention to provide an improved method for welding valve seat inserts into cylinder heads of different materials.

It is a further object of this invention to provide an improved cylinder head construction having a cylinder head and valve seat formed from different materials but providing an immediate boundary layer which is comprised of at least an alloy between these two materials and one of progressively different chemical composition between the base insert material and the base cylinder head material.

SUMMARY OF THE INVENTION

Several various aspects of the invention are adapted to be embodied in a method for affixing a valve seat insert into a cylinder head that comprises the steps of forming a recess in the cylinder head at the base of a passage extending through the cylinder head. An insert to be received in the recess is formed and has an opening which is adapted to form a flow opening that registers with the cylinder head passage. The insert also has an outer surface that is to engage the portion of the cylinder head that defines the recess. Pressure is applied to the cylinder head and insert for forcing the insert into the cylinder head recess.

In accordance with a first feature of the invention, the application of pressure and the shaping of the cylinder head recess and the insert is such that the insert is held under compression when in the recess.

In accordance with another method embodying the invention, the application of pressure and the shape of the insert and the cylinder head recess is such that the size of the opening of the insert is reduced upon insertion into the recess.

In accordance with a still further feature of a method embodying the invention, the application of pressure and the shape of the recess and the insert is such that a moment is not created on the insert which would result in the application of tensile forces on the insert.

A further feature of the invention is adapted to be embodied in a valve seat for insertion into a cylinder head recess at the end of a flow passage formed in the cylinder head. The valve seat has an opening that registers with the flow passage of the cylinder head when inserted and a cylindrical outer surface having a tapered section and ending in a lower surface opposite the combustion chamber that is disposed at an angle to the opening within the range of ±15° to a plane that is perpendicular to the axis of the opening.

A still further feature of the invention is adapted to be embodied in a method for resistance welding a valve seat insert into a cylinder head recess wherein an intermediate layer is formed between the valve seat material and the cylinder head material and is diffused or bonded upon welding so as to form a transition region between the base valve seat material and the cylinder head material so that the material varies from the base valve seat material to an alloy between the intermediate layer material and the valve seat, the intermediate layer material, to an alloy between the intermediate layer material and the cylinder head and, finally, to the base cylinder head material.

DESCRIPTION OF THE PREFERRED EMBODIMENTS

Figure 1:
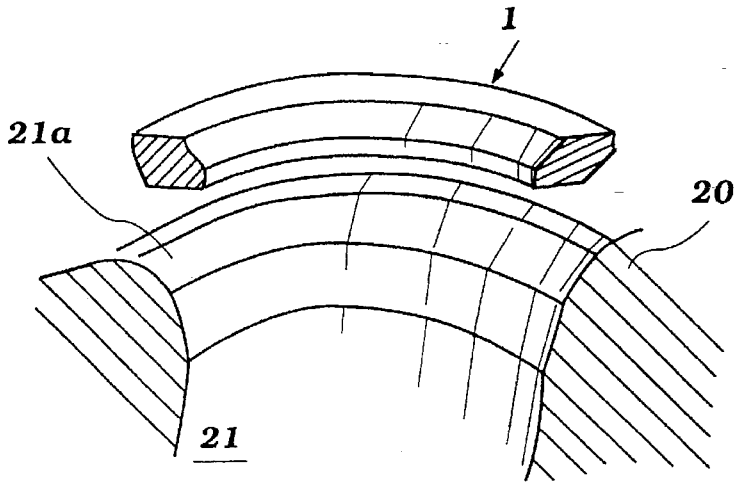
FIG. 1 is a sectional perspective view of a recess at the termination of a passage in a cylinder head and a valve seat prior to inserting in the recess, according to the present invention.
Figure 2:
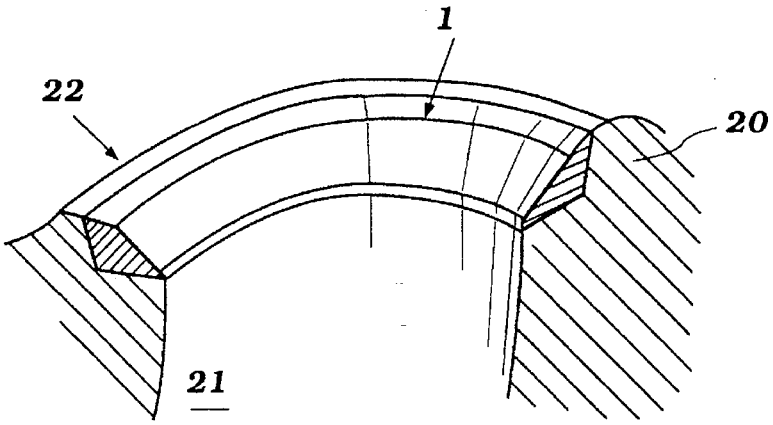
FIG. 2 is a sectional perspective view of the valve seat insert assembled into the cylinder head recess.

The present invention provides an improved valve seat and method of joining a valve seat insert into a cylinder head recess. With reference to FIG. 1, a valve seat insert 1 of the present invention is shown prior to installation in a tapered recess 21*a* of an air intake or exhaust port 21 of a cylinder head 20. The valve seat insert 1 comprises an annular member, only a portion of which is shown. As will be described in more detail below, the valve seat insert 1 is pressed into the tapered recess 21*a* to form the valve seat 22 shown in FIG. 2.

Figure 3:
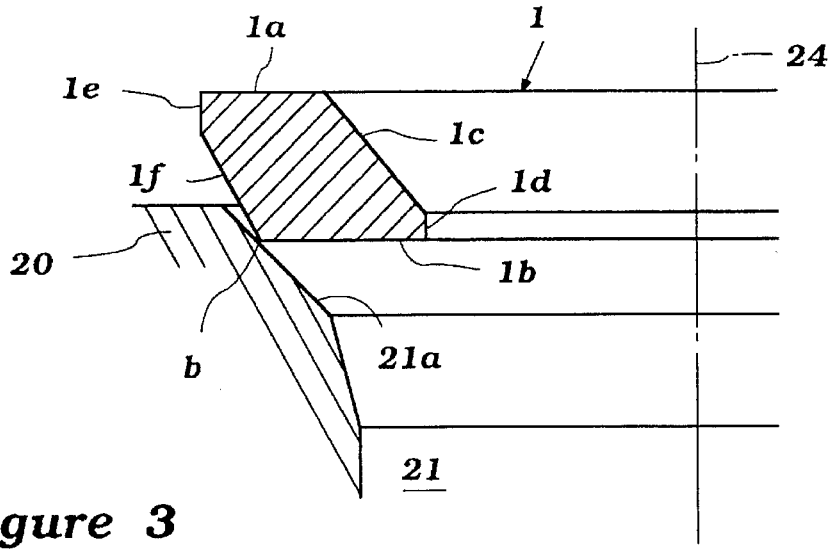
FIG. 3 is a sectional view of the valve seat insert of the present invention.

Now with reference to FIG. 3, the specific geometry of the valve seat insert 1 will be described. The valve seat insert 1 is preferably formed with a polygonal cross section having a plurality of exterior surfaces. More particularly, the valve seat insert 1 includes a top surface 1*a* facing the combustion chamber, a bottom surface 1*b* generally parallel to the top surface 1*a*, an inner tapered surface 1*c* extending downward and inward from the top surface 1*a*, an interior surface 1*d* adjacent and generally perpendicular to the bottom surface 1*b*, a short outer surface 1*e* adjacent the top surface 1*a* and an outer tapered surface if extending between the outer surface 1*e* and the bottom surface 1*b*. The intersection of the outer tapered surface if and bottom surface 1*b* forms a point of contact with the tapered recess 21*a* of the cylinder head 20. Each of the tapered surfaces can be described relative to a common central axis 24 of both the passage 21 and the valve seat insert 1. In a preferred form, the taper of surface 21*a* is greater with respect to the central axis 24 than the taper of the outer surface 1*f* of the valve seat insert 1. This ensures the circular line contact between the valve seat insert 1 and cylinder head 20 at b.

FIGS. 4*a*–4*d* illustrate various steps in the bonding process between the valve seat insert 1 and the cylinder head 20. The bonding may be accomplished by simply pressing the valve seat insert 1 into the tapered recess 21*a*, or the compression may be combined with a resistive current flow which causes the materials being bonded to heat up and soften. Such a procedure is typically known as resistance welding.

Figure 4A:
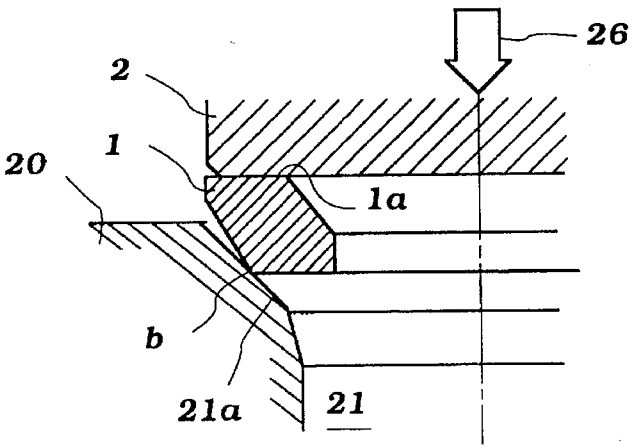
FIGS. 4*a*–4*d* are sectional diagrams showing an installation procedure of the valve seat insert into the cylinder head recess.
Figure 4B:
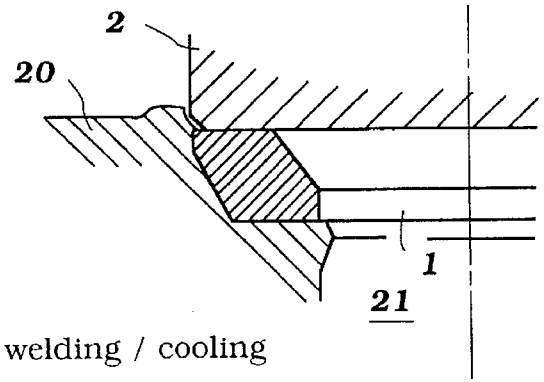

In FIG. 4*a*, the preferred valve seat insert 1 is positioned in the tapered recess 21*a* with the circular line of contact b providing the only contact. A downward force, illustrated by the arrow 26 is applied by an electrode 2, or press if no current is being applied, to the upper surface 1*a* of the valve seat insert 1. The electrode 2 applies pressure perpendicularly downward and current is passed therethrough. The valve seat insert 1 and cylinder head 20 are heated to melting or near melting temperature in the vicinity of the contact surfaces, whereupon the current is cut. The material of the cylinder 20 is typically of a lower hardness than the material of the valve seat 1, and it thus undergoes plastic deformation as shown in FIG. 4*b* so that the valve seat is buried into the tapered recess 21*a*. Commonly, the valve seat insert is made of a material including iron (Fe) while the cylinder head 20 is made of an aluminum (Al) alloy.

Figure 4C:
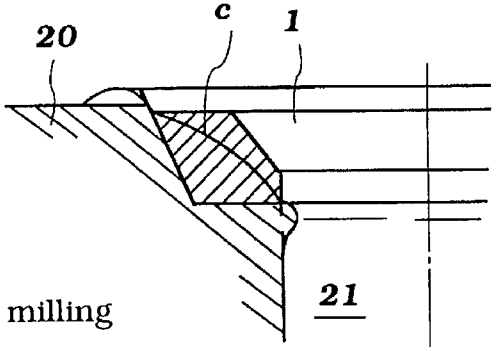
Figure 4D:
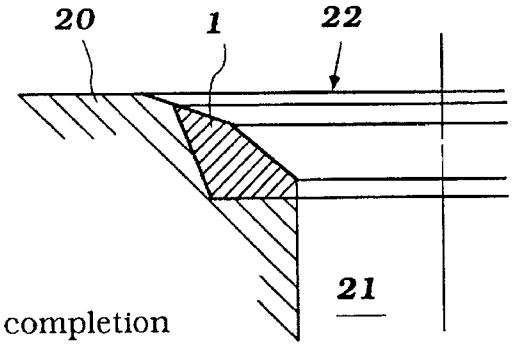

Following the deformation step of FIG. 4*b*, the valve seat junction is cooled and the excess material above the top surface of the cylinder head 20 and within the diameter of the recess 21*a* is milled, as shown in FIG. 4*c*. Subsequently, several facing steps form the valve seating surfaces indicated by the dashed line C in FIG. 4*c* and the result is the finished valve seat shown in FIG. 4*d*. The valve seat insert 1 is thus securely bonded with the cylinder head 20 around the air intake or exhaust port 21. A similar procedure is utilized to perform a valve seat around the exhaust ports of the cylinder head.

Figure 5A:
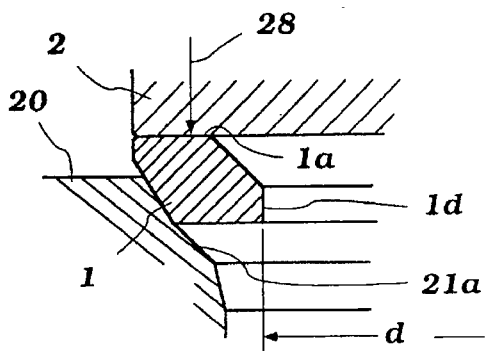
FIG. 5*a* is a sectional view illustrating one means of applying pressure to a valve seat insert during an installation process.
Figure 5B:
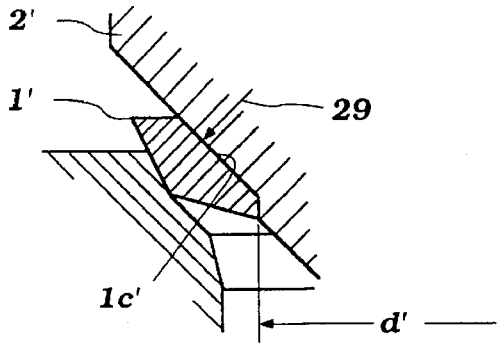
FIG. 5*b* is a partial sectional view showing a second means of applying pressure to a valve seat insert during an installation process.
Figure 6:
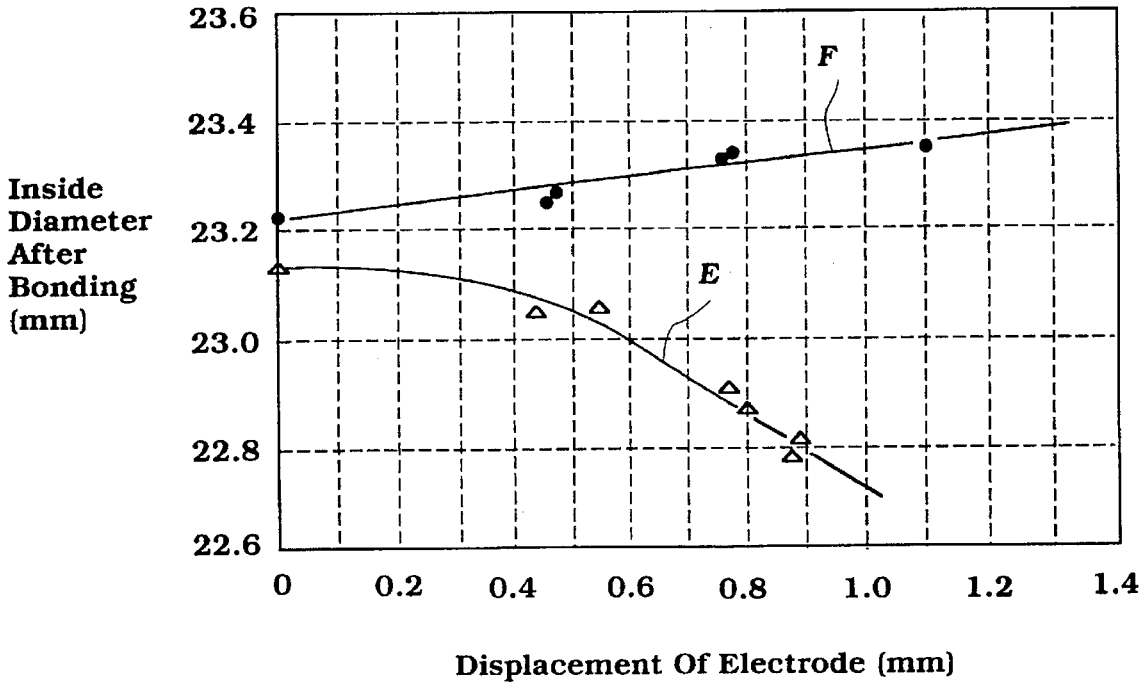
FIG. 6 is a graph showing the relationship between electrode displacement and valve seat insert inside diameter for two different pressure application methods.

FIGS. 5*a* and 5*b* illustrate two different ways in which pressure is applied to a valve seat insert during installation into a cylinder head recess. In FIG. 5*a*, the electrode 2 applies a downward pressure generally along the central axis of the valve seat insert 1, as indicated by arrow 28. This situation, in which the electrode 2 is pressing perpendicularly downward on the top surface 1*a* of the valve seat insert 1 is termed "top surface pressure." The diameter d indicates the inner diameter of the valve seat insert 1, or the diameter of the inner surface 1*d*. During installation, and due to the preferred geometry of the valve seat insert 1 and cylinder head recess 21*a*, the diameter d will reduce. With reference to the graph of FIG. 6, the curve E indicates the change in the inside diameter d (in millimeters) of the valve seat insert 1 after installation in the cylinder head 20 as the vertically downward displacement of the electrode 2 increases. Due to the fact that the valve seat insert 1 is preferably made of a material which is stronger in compression than in tension, the valve seat insert remains undamaged by this change in dimension. As mentioned above, the valve insert 1 is preferably constructed of a material include iron (Fe).

In contrast to the installation shown in FIG. 5*a*, FIG. 5*b* illustrates a "taper surface pressure" applied by a tapered electrode 2' applied to a valve seat insert 1'. In this method, the electrode 2' applies a normal force 29 to a tapered inside surface 1*c'* of the valve seat insert 1'. In this method, the inside diameter d' will increase during installation of the valve seat insert 1'. This increase is shown by the curve F in FIG. 6 versus the vertically downward displacement of the electrode 2. An increase in the inner diameter d' of the valve seat insert 1' may result in damage due to tensile stresses, either during installation or subsequently during use of the valve seat. Thus, in accordance with a preferred embodiment top surface pressure is utilized on the valve seat insert 1 during installation into the cylinder head 20.

Figure 7:
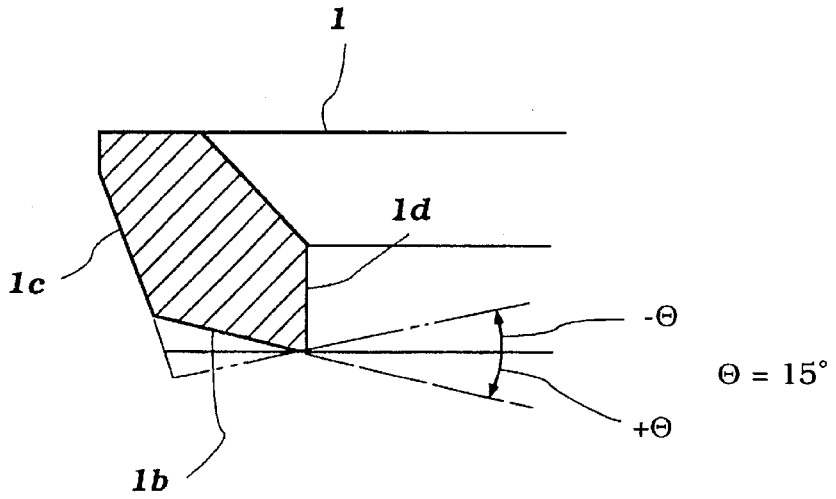
FIG. 7 is a sectional view of a valve seat insert illustrating various tapers for a bottom surface.
Figure 8:
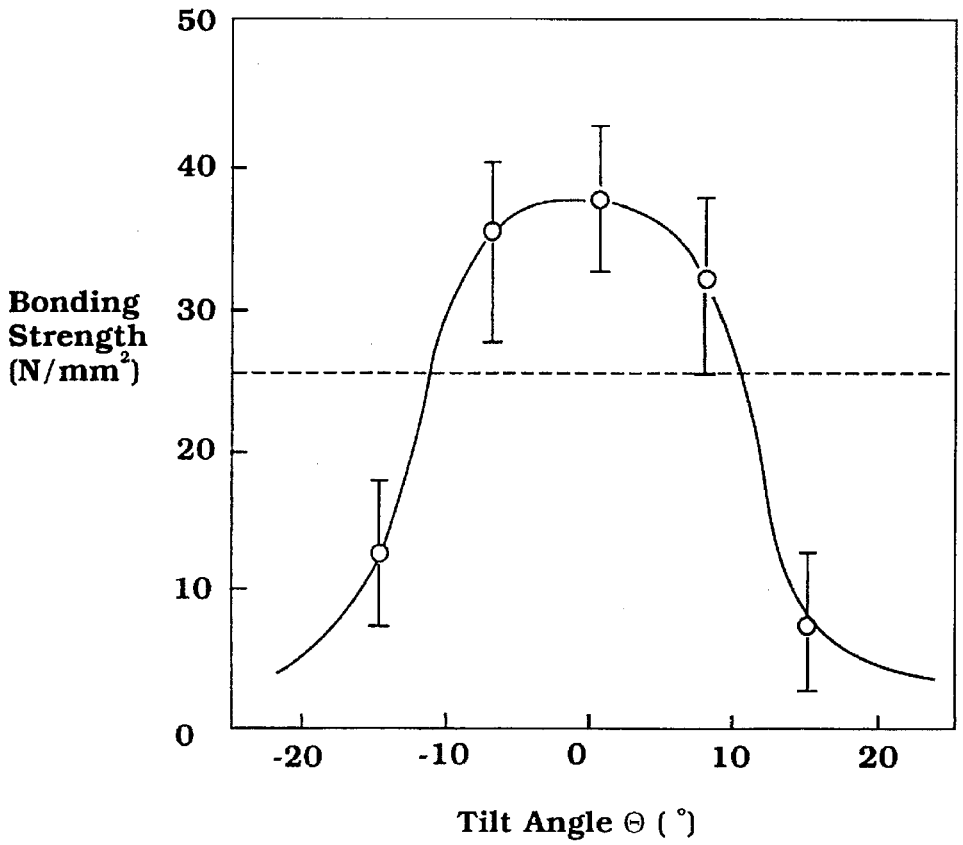
FIG. 8 is a graph illustrating the results of measured joint strength for various taper angles in the bottom surface of a valve seat insert.

In FIG. 7, various tapers of the lower surface 1*b* of the valve seat insert 1 are illustrated. The taper angle is given by θ, which angle is determined by the intersection of the surface 1*b* with a horizontal line perpendicular to the central axis 24 of the valve seat insert 1. The sign of the angle θ is positive for clockwise rotation and negative for counterclockwise. FIG. 8 is a graph showing the results of testing of the bond strength between the valve seat insert and the cylinder head for various angles θ of the lower surface 1*b*. As is evident from the test results, the bonding strength for the valve seat insert 1 is highest when the angle θ of the lower surface 1*b* is 0°; in other words, when the bottom surface 1*b* is perpendicular to the central axis 24. However, the bond strength is desirably greater than 25 $N/mm^2$, allowing the angle θ to be varied within ±10°. However, satisfactory results have been obtained for inserts having the taper angle θ of the bottom surface 1*b* within ±15°.

Figure 9A:
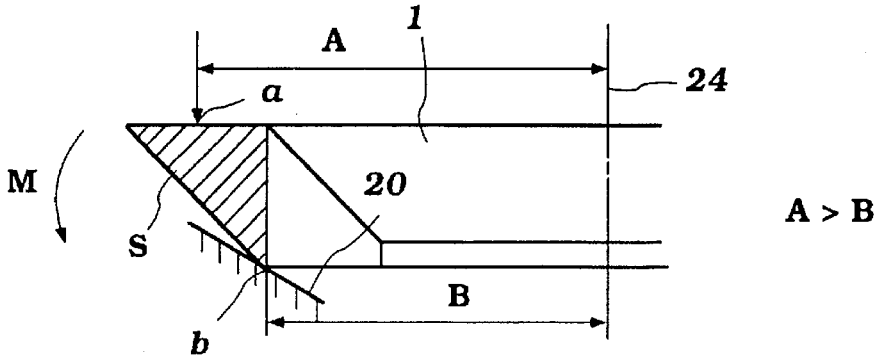
FIGS. 9*a*–9*c* are diagrams illustrating the bending moments in different cross-sectional shapes of valve seat inserts during installation.
Figure 9B:
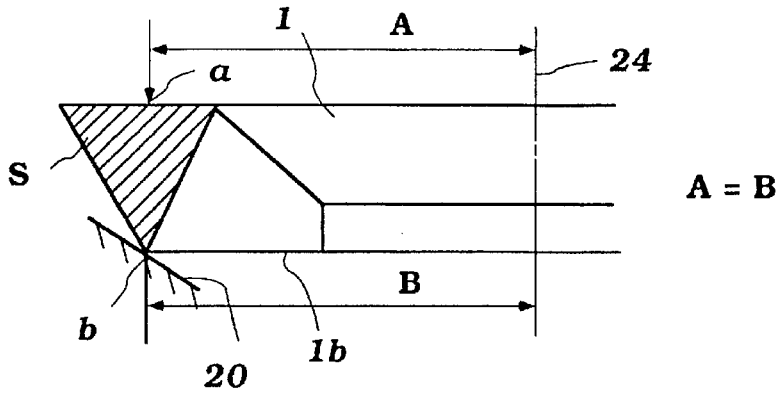
Figure 9C:
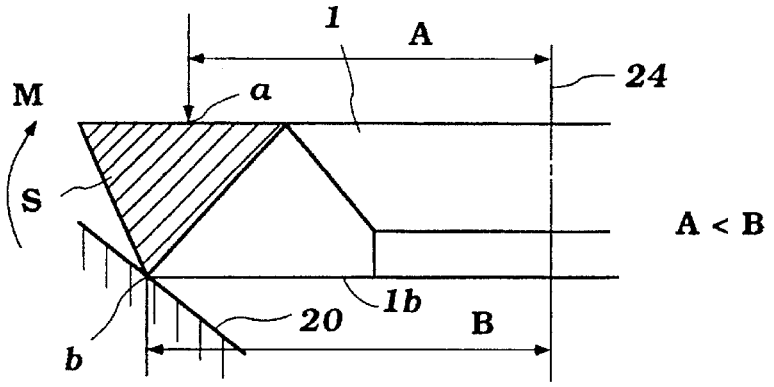

FIGS. 9*a*–9*c* illustrate an electric current path through a valve seat insert 1 having a bottom surface 1*b* which is perpendicular to the central axis 24. In these illustrations, the force P represents the downward force applied by the electrode 2 on the valve seat insert 1. The actual point of application of the electrode force P on the upper surface 1*a* is given at a. The distance A represents the distance between the application of the force P and the central axis 24. The distance B represents the distance from the initial circular line of contact b between the valve seat insert 1 and cylinder head 20 and the central axis 24. The cross-hatched area S represents the initial current flow path from the electrode 2 to the cylinder head 20 through the valve seat insert 1.

FIG. 9*a* shows the case where A>B and a part of the current path S lies outside the line of contact b for the valve seat insert 1. This situation may cause expansion of the valve seat insert 1 outside the contact point b under the action of a torque M (counterclockwise direction) set up by the applied force P. The result is that deformation outside of the line of contact b is promoted, and it is not only impossible to obtain a normal bond, but the valve seat insert 1 is prone to cracking or becoming damaged. This situation is quite undesirable.

In the example of FIG. 9*b*, the distance A equals B, so that no torque is applied (M=0) as a result of the downward pressure P. When the current is turned on, the heating is confined to the current path S. This arrangement ensures that no tensile stresses will be set up within the valve seat insert 1, preventing cracking or other damage during installation or afterward.

In the third example, shown in FIG. 9*c*, the distance A<B and there is a torque M (clockwise direction) applied due to the pressure P. The heated area of the current path S is weighted toward the inside of the valve seat insert 1, assuring the contact of contact point B of the valve seat insert with the cylinder head 20. This enables a uniform bond to be formed with the required strength and prevents cracking or other damage to the valve seat insert 1 during installation or afterward.

It can thus be clearly seen that the present method of installing a valve seat insert preferably utilizes a top surface pressure, a bottom surface 1*b* having a taper with respect to a plane perpendicular to the central axis within ±15°, and a distance between the center of application of the deformation force and the central axis that is greater than or equal to the distance between the initial line of contact between the valve seat insert 1 and the cylinder head 20. This preferred arrangement results in no tensile stresses being applied to the valve seat during installation, preventing cracking or other damage and leading to a strongly bonded joint.

Multiple-Component Valve Seat Insert

Figure 10:
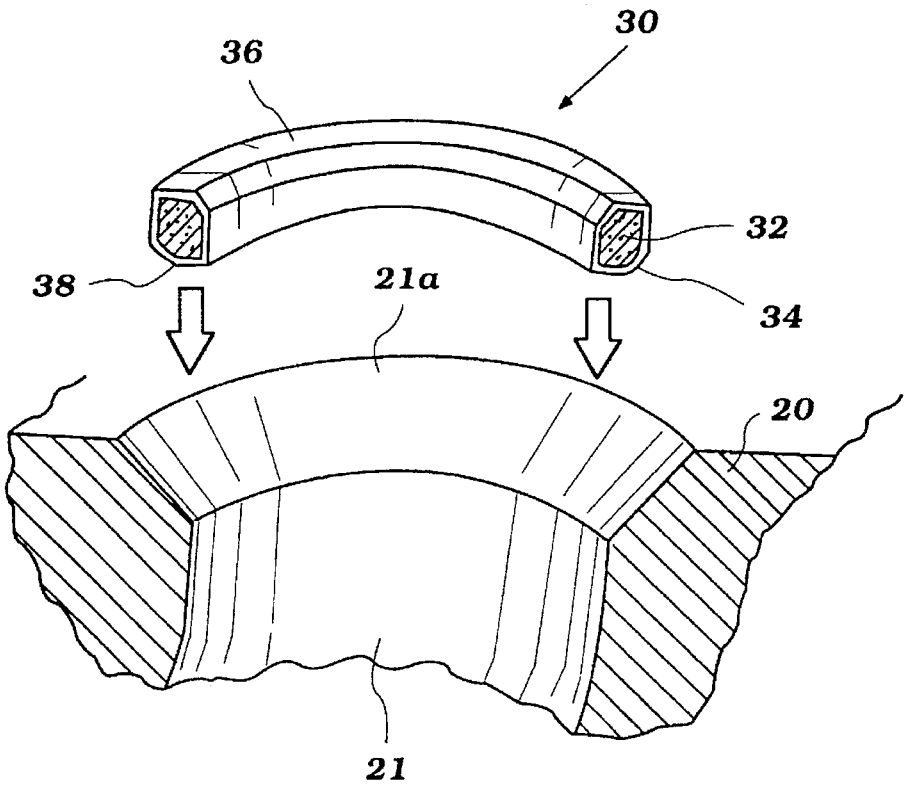
FIG. 10 is a sectional perspective view of the cylinder head recess and one embodiment of a two-component valve seat insert prior to installation in the recess.
Figure 12:
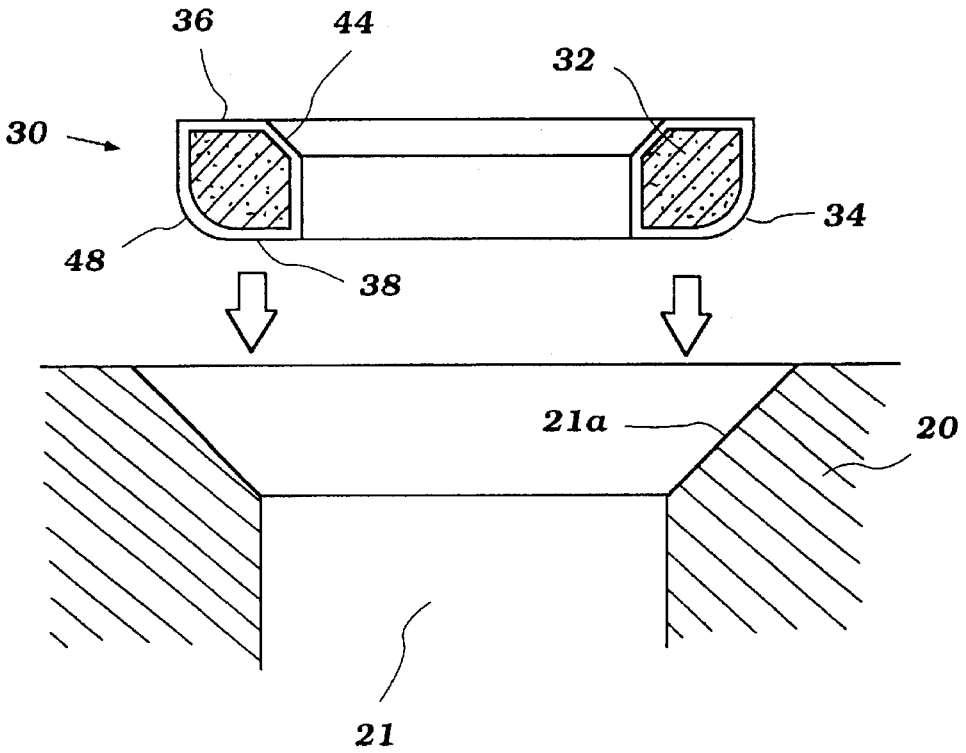
FIG. 12 is a sectional view of the two-component valve seat insert of FIG. 10 prior to joining to a cylinder head recess.

In another embodiment of the present invention, a preferred valve seat insert 30, shown in FIGS. 10 and 12, comprises more than one material. In this particular embodiment, the valve seat insert 30 comprises an inner component of valve seat material 32 and an outer coating layer 34 of a different material. The valve seat insert 30 is shown in the vicinity of a cylinder head air intake passage 21 having a tapered recess 21*a*. The valve seat insert 30 is preferably installed into the cylinder head 20, utilizing the preferred methods as described above. More particularly, the valve seat insert 30 is preferably installed using an electrode (not shown), which presses directly downward on an upper surface 36 of the valve seat insert 30 along a central axis of the valve seat insert and passage 21. Further, the geometry of the valve seat insert 30 and tapered recess 21*a* is such that the center of application of downward force is closer to the central axis than a point of contact between the valve seat insert 30 and the tapered recess 21*a*. Finally, a lower surface 38 of the valve seat insert 30 is preferably within ±15° of a plane extending perpendicularly to the central axis of the valve seat insert 30.

Figure 11:
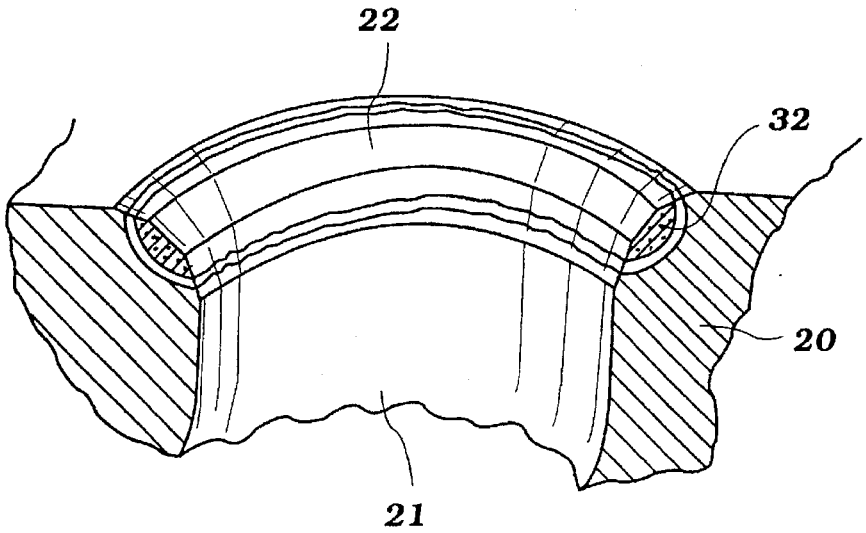
FIG. 11 is a sectional perspective view of the two component valve seat insert after installation in the cylinder head recess.

The inner valve seat material 32 may be a sintered ferrous (Fe) or copper (Cu) alloy, which provides resistance to abrasion and oxidation. In addition to the surface coating layer 34, the valve seat insert 30 may also be fitted with a backing material, as will be more fully described with respect to FIGS. 16–19. The valve seat material is preferably one that has a high electrical conductivity, and moreover, the pores in the sintered valve seat material are impregnated with a solution to further increase the electrical conductivity. Thus, when electricity is passed through the valve seat insert 30 from the electrode (not shown), the internal heating of the valve seat material is reduced and concentrated at the junction surfaces between the valve seat insert 30 and cylinder head 20 from resistive heat dissipation. The valve seat insert 30 is thus firmly welded to the cylinder head 20 to form the valve seat 22, as seen in FIG. 11.

FIGS. 13*a*–13*d* illustrate the production process of joining the valve seat insert 30 to the cylinder head 20 and subsequent shaping into the valve seat 22. Initially, in FIG. 13*a*, an electrode 40 having tapered surfaces 42 applies a normal force to a tapered surface 44 of the valve seat insert 30, upon downward movement as indicated by the arrow 46. The curvilinear undersurface 48 of the valve seat insert 30 contacts the tapered recess 21*a* at approximately a circular line. Although a tapered electrode 40 is shown during installation of the two-component valve seat 30, a flat electrode contacting the upper surface 36 is preferred, as was described above with reference to FIGS. 5*a*, 5*b*, and 6. However, although preferred, the use of a flat electrode is not exclusive to installation of the two-component valve seat insert 30.

Figure 13A:
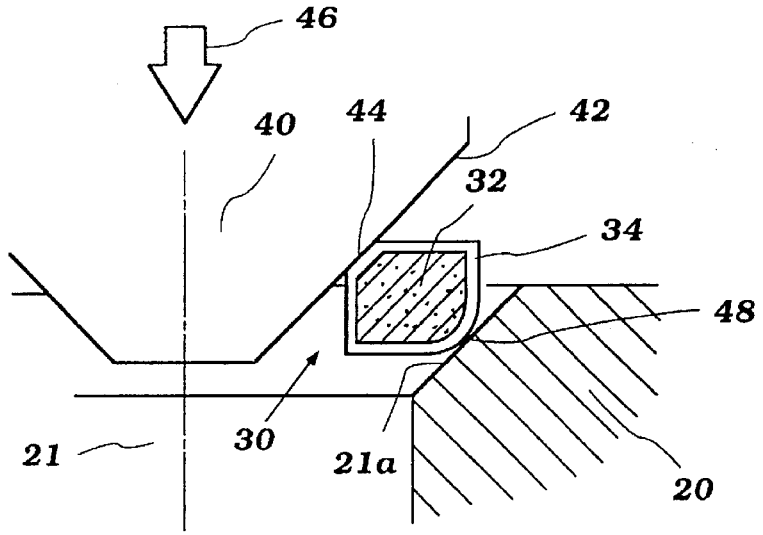
FIGS. 13*a*–13*d* are sectional diagrams showing the formation of the valve seat area utilizing a two-component valve seat insert distinct from the material of the cylinder head.
Figure 13B:
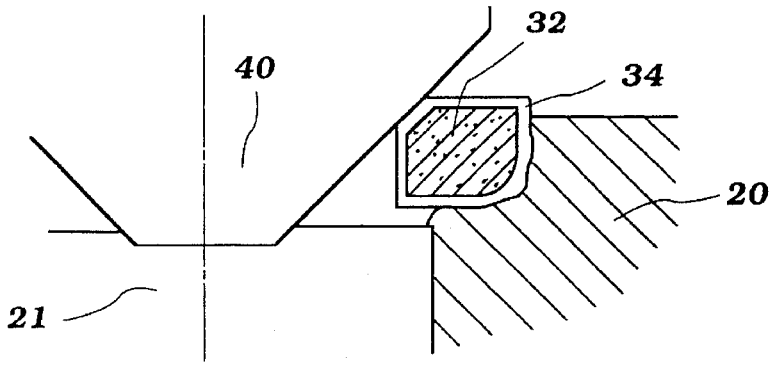
Figure 13C:
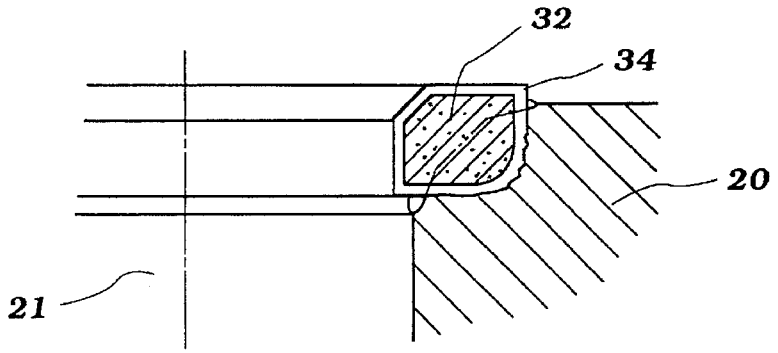
Figure 13D:
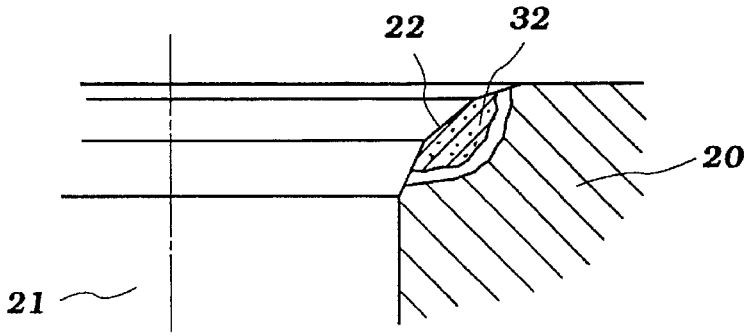

In FIG. 13*b*, current is passed through the electrode 40 as it presses down on the valve seat insert 30. The downward pressure and resistive heating caused by the current flow results in plastic deformation of the cylinder head, which has a lower resistance to such deformation than the valve seat insert 30. Thus, the valve seat insert 30 is buried in the tapered recess 21*a* of the cylinder head 20. After cooling, the valve seat insert 30 is milled to the broken line shown in FIG. 13*c* to remove material and form the finished valve seat 22, as seen in FIG. 13*d*.

Figure 14:
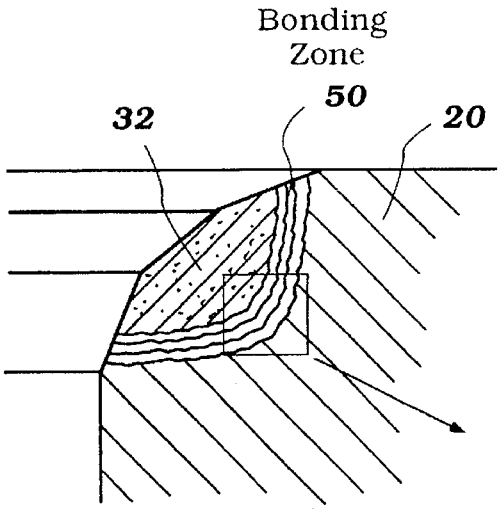
FIG. 14 is a detailed sectional view of a two-component valve seat insert of FIG. 12 after installation in a cylinder head recess.
Figure 14A:
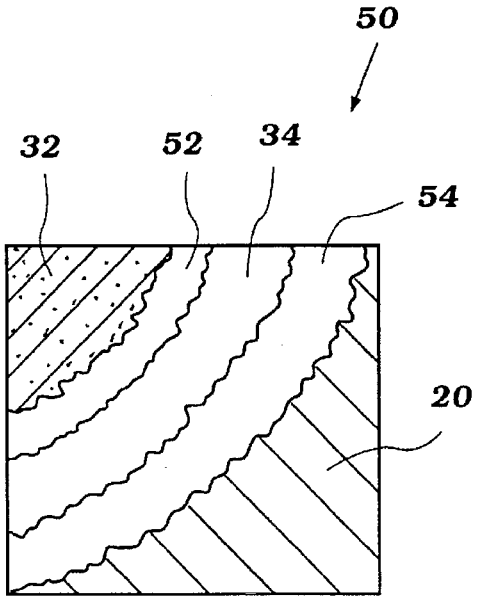
FIG. 14*a* is an enlarged portion of a bonding zone of the valve seat area contained within the square of FIG. 14.

FIGS. 14 and 14*a* show detailed representations of a bonding zone 50 formed at the interface of the valve seat insert 30 and cylinder head 20. The bonding zone 50 comprises a multi-layer intermetallic zone formed by dispersion and migration of the various metallic molecules utilized in the valve seat material 32, coating layer 34, and cylinder head 20. In a preferred embodiment, the valve seat material 32 comprises a sintered iron alloy impregnated with copper, while the coating layer 34 is a material high in copper, and the cylinder head 20 is fabricated of an aluminum alloy. The layered intermetallic composition of the valve seat 22 thus varies gradually from the valve seat surface to the cylinder head. This allows a gradual change in coefficients of thermal expansion so that large internal stresses do not build up in the valve seat material 32 and cause it to crack, even when there is a great deal of heat expansion from the aluminum alloy cylinder head 20. In the embodiment of FIG. 14*a*, the bonding zone 50 comprises the valve seat material 32 adjacent a first reactive layer 52, the coating layer 34 material, and then a second reactive layer 54 abutting the cylinder head 20.

Figure 15:
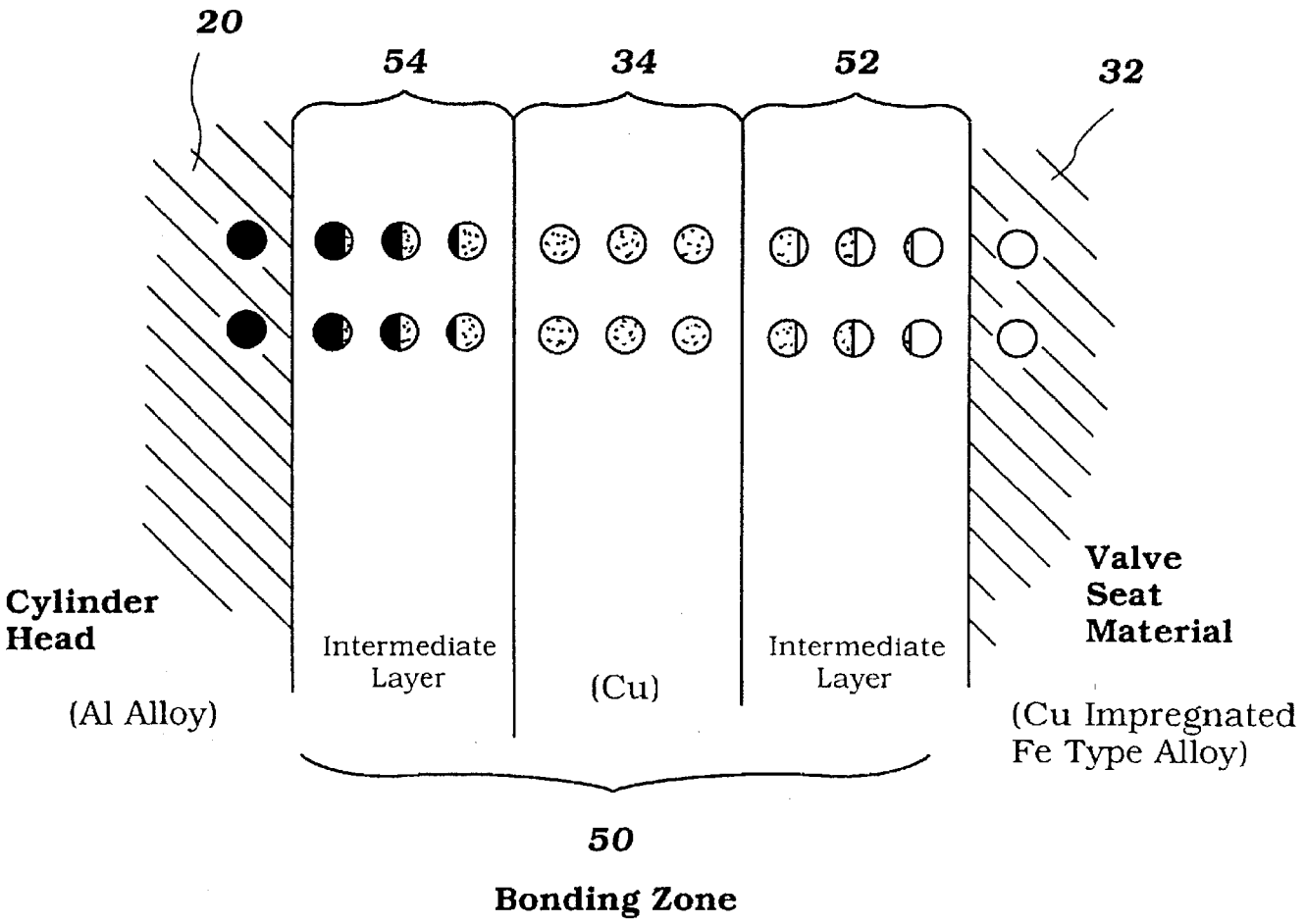
FIG. 15 is a diagram of the intermetallic compound intermediate layers of the bonding zone illustrated in FIG. 14*a;*

Now with reference to FIG. 15, the gradual change in metallic composition can be seen more clearly. The first intermediate layer 52 between the valve seat material 32 (Fe-type sintered alloy) and coating layer 34 material (Cu) amounts to an intermetallic deposit that is higher in copper content in the areas closer to the coating layer 34 and higher in iron content in the areas closer to the valve seat material 32. The second intermediate layer 54 between the coating layer 34 (Cu) and the cylinder head 20 (aluminum alloy) is an intermetallic deposit or solid solution that has more copper content in the areas closer to the coating layer material 34 and more aluminum content in the areas closer to the cylinder head 20.

Figure 16:
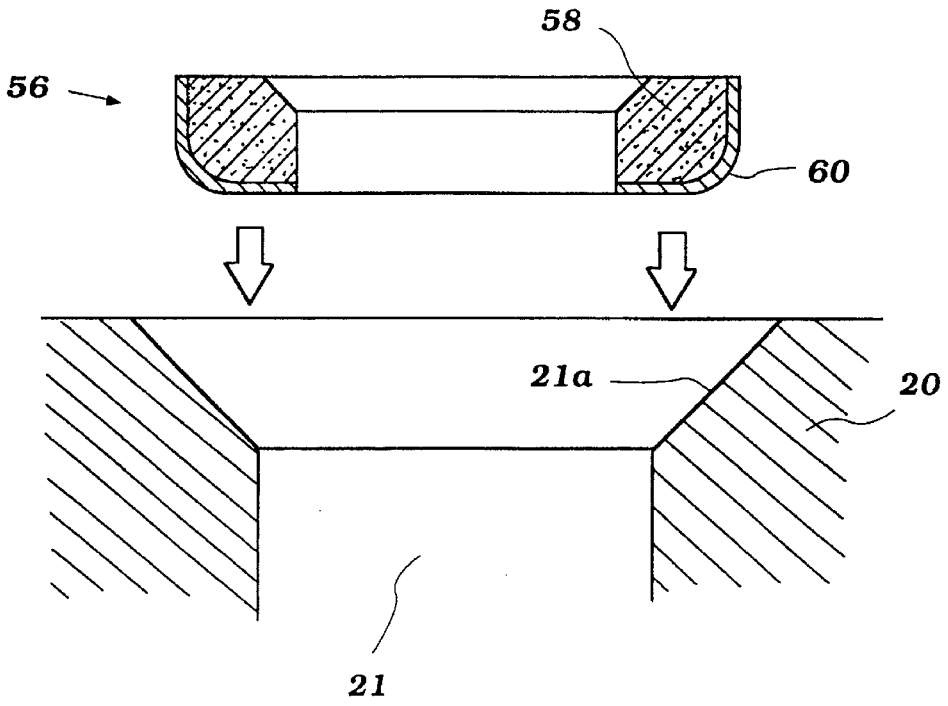
FIG. 16 is a sectional view of a further embodiment of a two component valve seat insert prior to installation in a cylinder head recess.
Figure 17:
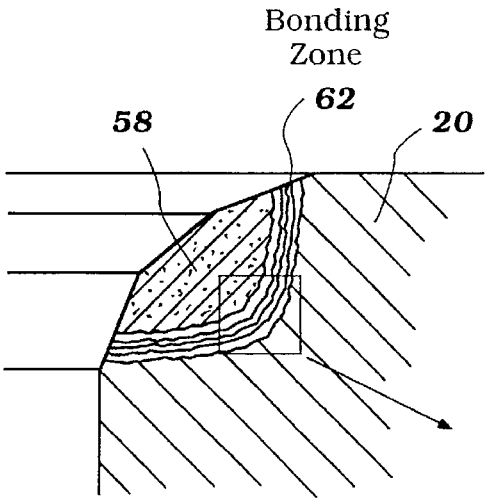
FIG. 17 is a detailed sectional view of a valve seat area of the two-component valve seat insert of FIG. 16 installed into a cylinder head recess of different composition.
Figure 17A:
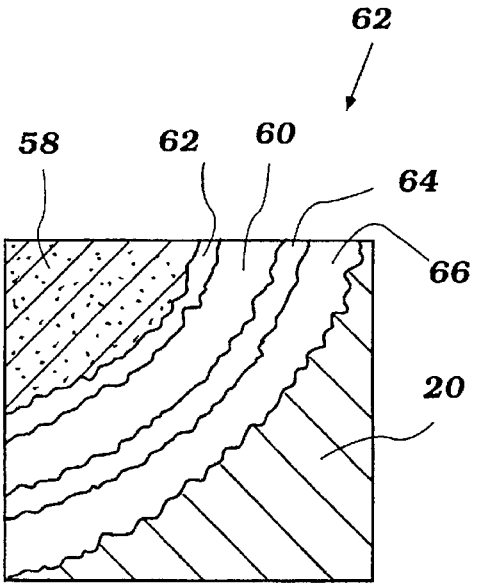
FIG. 17*a* is an enlarged section of the bonding zone contained within the square of FIG. 17.

FIGS. 16 and 17 illustrate another embodiment of a valve seat insert of the present invention. This valve seat insert 56 comprises a valve seat material 58 having a backing material 60 on two adjacent sides, the exterior side and the lower side. After performing the above-described resistance welding, there will be dispersion of intermetallic components on both sides of the backing material 60 at the junction with the cylinder head 20. These dispersion layers are shown in FIG. 17*a* at 62, 64, and 66. In this particular example, the valve seat material 58 may be a ferrous sintered alloy (impregnated with Cu, for example) or a steel cast alloy. The backing material 60 is metallurgically reactive to some extent with the valve seat material 58, and can withstand the heat of sintering or casting. The backing material 60 preferably is compatible with the cylinder head 20 material, and an austenite steel (SUS 304, SUH 3) may advantageously be used. In the bonding zone 62, the first intermediate layer 62 is a mixture of the materials from the valve seat material 58 and the backing material 60. The second intermediate layer 34 is a mixture from the backing material 60 and the cylinder head 20 material, while the intermediate layer 66 is a dispersion layer of the cylinder head material 20 (aluminum alloy) toward the backing material 60. In the same manner as illustrated in FIG. 15, the components of the intermetallic compounds in the bonding zone 62 have been deposited so that their respective compositions vary gradually.

Figure 18:
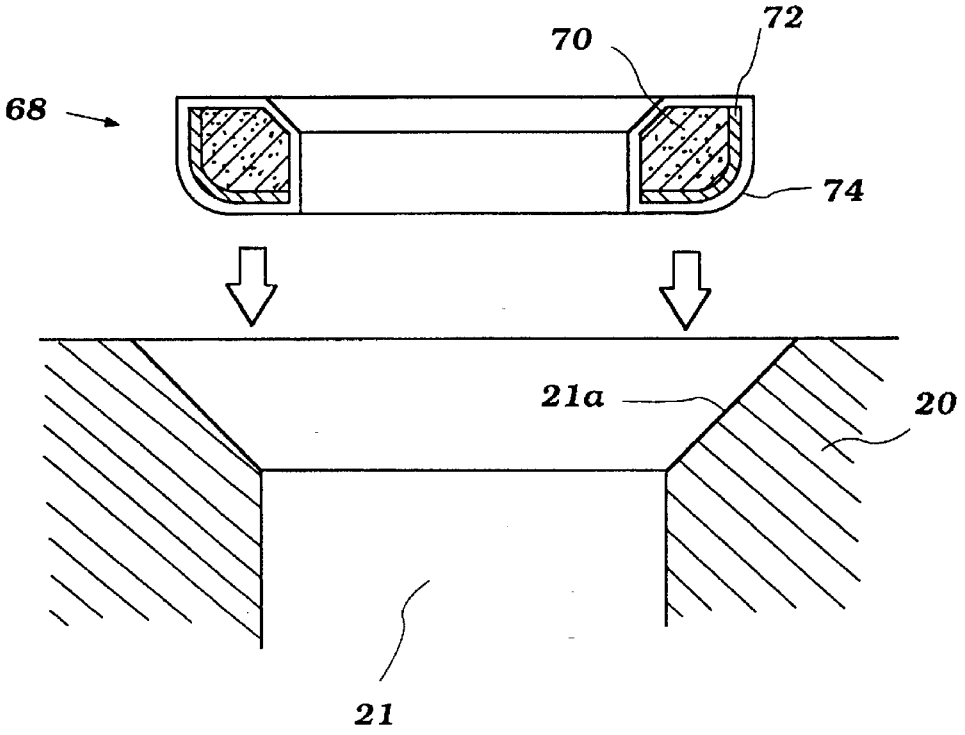
FIG. 18 is a further embodiment of a valve seat insert being constructed of multiple components prior to installation in a cylinder head recess.
Figure 19:
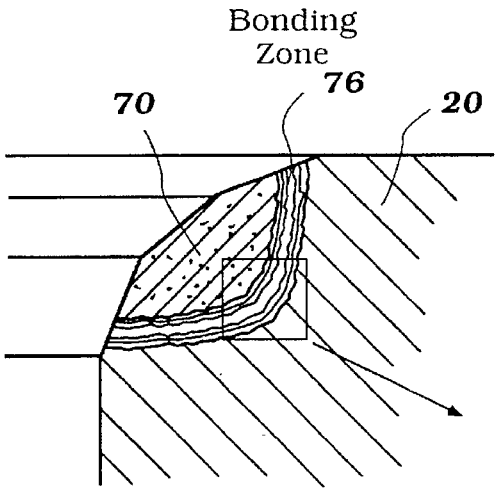
FIG. 19 is a detailed sectional view of a valve seat area after installation of the valve seat insert of FIG. 18 into the cylinder head recess of different composition.
Figure 19A:
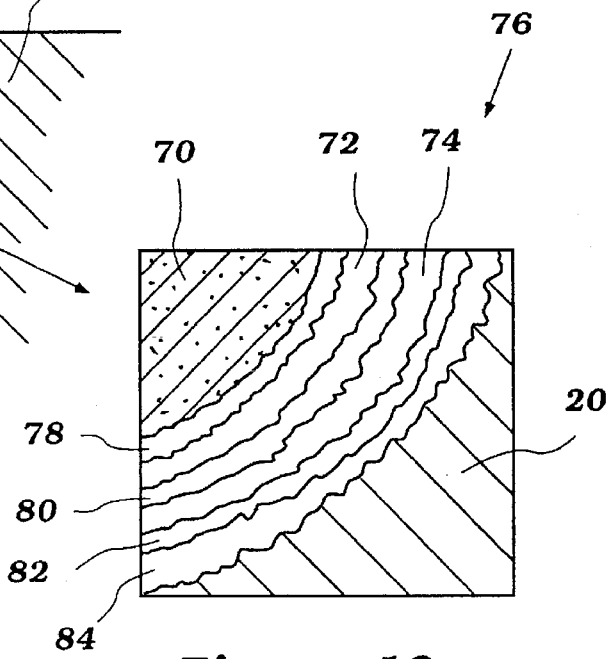
FIG. 19*a* is an enlarged sectional view of a portion of the bonding zone contained within the square of FIG. 19.

FIG. 18 shows a further alternative embodiment of a valve seat insert 68. The valve seat insert 68 comprises an inner valve seat material 70 having a backing material 72, much like the backing material 60 of FIG. 16, and an exterior coating layer 74. This multiple-component arrangement increases the bonding properties of the valve seat insert 68 with the aluminum alloy of the cylinder head 20. As seen in FIGS. 19 and 19*a*, the valve seat insert is joined to the cylinder head 20 in a bonding zone 76 by means of a number of intermediate layers. In particular, an intermediate layer 78 exists between the valve seat material 70 and the backing material 72, a second intermediate layer 80 exists between the backing material 72 and the coating layer 74, and mutual dispersion layers 82 and 84 exist between the coating layer 74 and the cylinder head 20.

Again referring to the bonding zone 76 of FIG. 19*a*, deposits have formed the intermediate layer 78, which is composed of a mutual dispersion of the valve seat material 70 and the backing material 72. The second intermediate layer 80 is a mutual dispersion layer composed of backing material 72 and coating layer 74. Finally, the intermediate layer 82 is a mutual dispersion layer of the coating layer 74 and the cylinder head 20, and the intermediate layer 84 is a dispersion of the coating layer 74 toward the cylinder head 20. In the same manner as described with reference to FIGS. 6 and 15, the compositions of the various intermetallic layers gradually change in the deposited intermetallic compound.

The aforegoing was an explanation of various embodiments of multiple component valve seat inserts of the present invention. In these embodiments, copper having a coefficient of thermal expansion equal to $17\times10^{-6}$/degree was used as the coating layer between the aluminum alloy cylinder head 20 and the sintered iron alloy valve seat material. However, any material having a coefficient of thermal expansion between that of the aluminum alloy ($23\times10^{-6}$/degrees) and the sintered iron alloy ($12\times10^{-6}$/degrees) could be used. Some examples would include Al-5%Si (coefficient of thermal expansion $20\times10^{-6}$/degrees), Cu-Zn, Cu-Sn, Cu-Ni-Si, etc. Therefore, the present invention is not limited to the specific materials described above.

It is to be understood that the foregoing description is that of preferred embodiments of the invention, and various changes and modifications may be made without departing from the spirit and scope of the invention, as defined by the appended claims.

What is claimed is:

1. A method of affixing a valve seat insert into a cylinder head comprising the steps of forming a recess in said cylinder head at the base of a passage extending therethrough, forming an insert to be received in said recess and having an opening adapted to form a flow opening registering with said cylinder head passage and an outer surface positioned to engage the part of said cylinder head defining said recess, applying pressure to said cylinder head and said insert for forcing said insert into said recess, and the application of pressure and the shaping of said cylinder head recess and said insert being such that said insert is held under compression when in said recess, and passing an electrical current through the insert and the cylinder head upon pressing of the insert into the cylinder head recess for effecting resistance bonding of said insert to said cylinder head.

2. A method of affixing a valve seat insert into a cylinder head of claim 1, wherein the valve seat insert outer surface portion is tapered.

3. A method of affixing a valve seat insert into a cylinder head of claim 2, wherein the recess is tapered.

4. A method of affixing a valve seat insert into a cylinder head of claim 3, wherein the angle of taper of the recess is different than the angle of taper of the insert with the angle of the recess taper being greater than the angle of the insert taper.

5. A method of affixing a valve seat insert into a cylinder head of claim 2, wherein the lower surface of the insert is disposed in the range of ±15° to a plane extending perpendicularly to the insert opening.

6. A method of affixing a valve seat insert into a cylinder head of claim 5, wherein the recess is tapered.

7. A method of affixing a valve seat insert into a cylinder head of claim 6, wherein the angle of taper of the recess is different than the angle of taper of the insert with the angle of the recess taper being greater than the angle of the insert taper.

8. A method of affixing a valve seat insert into a cylinder head of claim 7, wherein the lower surface of the insert is disposed in the range of ±15° to a plane extending perpendicularly to the insert opening.

9. A method of affixing a valve seat insert into a cylinder head of claim 3, wherein the outer surface of the insert and the recess are configured so that they first contact on a diameter that is less than the center of pressure applied to the insert.

10. A method of affixing a valve seat insert into a cylinder head of claim 9, wherein the angle of taper of the recess is different than the angle of taper of the insert with the angle of the recess taper being greater than the angle of the insert taper.

11. A method of affixing a valve seat insert into a cylinder head of claim 10, wherein the lower surface of the insert is disposed in the range of ±15° to a plane extending perpendicularly to the insert opening.

12. A method of affixing a valve seat insert into a cylinder head of claim 1, further including providing an intermediate material between the insert and the cylinder head which is of a different material that either insert and the cylinder head and where the insert and the cylinder head are of different materials prior to the pressing of the insert into the cylinder head for forming an alloy between the insert, the intermediate material, the intermediate material and the cylinder head upon the resistance bonding.

13. A method of affixing a valve seat insert into a cylinder head of claim 12, wherein the intermediate material is deposited on the insert prior to its being pressed into the cylinder head.

14. A method of affixing a valve seat insert into a cylinder head of claim 12, wherein the intermediate material is affixed to the cylinder head in the recess before the insert is pressed into the cylinder head.

15. A method of affixing a valve seat insert into a cylinder head of claim 14, wherein there are two intermediate layers one initially affixed to the insert and the other initially affixed to the cylinder head in the recess.

16. A method of affixing a valve seat insert into a cylinder head of claim 15, wherein the intermediate layer is affixed by adhering to the cylinder head and by deposition to the insert.

17. A method of affixing a valve seat insert into a cylinder head of claim 12, wherein there are provided two dissimilar intermediate layers.

18. A method of affixing a valve seat insert into a cylinder head of claim 17, wherein one of the intermediate layers is initially placed on the insert prior to its insertion into the cylinder head.

19. A method of affixing a valve seat insert into a cylinder head of claim 17, wherein one of the intermediate layers is initially placed on the cylinder head before the insert is pressed into place.

20. A method of affixing a valve seat insert into a cylinder head of claim 17, wherein both of the intermediate layers are initially positioned on the insert.

21. A method of affixing a valve seat insert into a cylinder head of claim 17, wherein both of the intermediate layers are initially placed on the cylinder head.

22. A method of affixing a valve seat insert into a cylinder head comprising the steps of forming a recess in said cylinder head at the base of a passage extending therethrough, forming an insert to be received in said recess and having an opening adapted to form a flow opening registering with said cylinder head passage and an outer surface positioned to engage the part of said cylinder head defining said recess, applying pressure to said cylinder head and said insert for forcing said insert into said recess, the application of pressure and the shape of said insert and said cylinder head recess being such that the size of the opening in said insert is reduced upon insertion into said recess, and passing an electrical current through the insert and the cylinder head upon pressing of the insert into the cylinder head recess for effecting resistance bonding of said insert to said cylinder head.

23. A method of affixing a valve seat insert into a cylinder head of claim 22, further including providing an intermediate material between the insert and the cylinder head which is of a different material that either insert and the cylinder head and where the insert and the cylinder head are of different materials prior to the pressing of the insert into the cylinder head or forming an alloy between the insert, the intermediate material, the intermediate material and the cylinder head upon the resistance bonding.

24. A method of affixing a valve seat insert into a cylinder head comprising the steps of forming a recess in said cylinder head at the base of a passage extending therethrough, forming an insert to be received in said recess and having an opening adapted to form a flow opening registering with said cylinder head passage and an outer surface positioned to engage the part of said cylinder head defining said recess, applying pressure to said cylinder head and said insert for forcing said insert into said recess, and passing an electrical current through said insert and said cylinder head during at least a portion of the time that pressure is applied for heating the cylinder head material for affixing said insert into said cylinder head recess.

25. A method of affixing a valve seat insert into a cylinder head of claim 24, wherein the valve seat insert outer surface portion is tapered.

26. A method of affixing a valve seat insert into a cylinder head of claim 25, wherein the recess is tapered.

27. A method of affixing a valve seat insert into a cylinder head of claim 26, wherein the angle of taper of the recess is different than the angle of taper of the insert with the angle of the recess taper being greater than the angle of the insert taper.

28. A method of affixing a valve seat insert into a cylinder head of claim 25, wherein the lower surface of the insert is disposed in the range of ±15° to a plane extending perpendicularly to the insert opening.

29. A method of affixing a valve seat insert into a cylinder head of claim 28, wherein the recess is tapered.

30. A method of affixing a valve seat insert into a cylinder head of claim 29, wherein the angle of taper of the recess is different than the angle of taper of the insert with the angle of the recess taper being greater than the angle of the insert taper.

31. A method of affixing a valve seat insert into a cylinder head of claim 26, wherein the outer surface of the insert and the recess are configured so that they first contact on a diameter less than the outer diameter of the insert and greater than the inner diameter of the insert.

32. A method of affixing a valve seat insert into a cylinder head as set forth in claim 24, wherein the cylinder head is formed from a material comprised of the group of aluminum and aluminum alloys, and the insert ring is formed as a sintered ferrous ring with a coating applied thereto.

33. A method of affixing a valve seat insert into a cylinder head as set forth in claim 32, wherein the coating comprises copper.

34. A method of resistance welding an insert to a cylinder head comprising the steps of forming an insert having an opening adapted to register with a flow opening in the cylinder head, forming a recess in the cylinder head at one of end of its opening for receiving said insert, said cylinder head and said insert being formed from dissimilar materials, interposing an intermediate material between said insert in said cylinder head, simultaneously pressing said insert into said recess and passing an electric current through insert, said intermediate material and said cylinder head for effecting bonding of cylinder head, said intermediate material and said insert to each other to form a layer that varies from the material of the insert, an alloy of the insert and the intermediate layer, the intermediate layer, an alloy of the intermediate layer and the cylinder head and the cylinder head.

* * * * *